US008323047B2

(12) United States Patent
Reusche et al.

(10) Patent No.: US 8,323,047 B2
(45) Date of Patent: Dec. 4, 2012

(54) CORDSET ASSEMBLY

(75) Inventors: Thomas K. Reusche, Elburn, IL (US); Philip E. Chumbley, Aurora, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 332 days.

(21) Appl. No.: 12/780,042

(22) Filed: May 14, 2010

(65) Prior Publication Data

US 2010/0221957 A1 Sep. 2, 2010

Related U.S. Application Data

(63) Continuation-in-part of application No. 12/028,257, filed on Feb. 8, 2008, now Pat. No. 7,833,037.

(60) Provisional application No. 60/895,324, filed on Mar. 16, 2007, provisional application No. 60/909,275, filed on Mar. 30, 2007, provisional application No. 60/980,215, filed on Oct. 16, 2007, provisional application No. 61/181,975, filed on May 28, 2009.

(51) Int. Cl.
*H01R 13/52* (2006.01)

(52) U.S. Cl. ..... 439/359; 411/417; 411/437

(58) Field of Classification Search ..... 439/638, 439/271, 320, 359, 106, 107; 411/417, 418, 411/437

See application file for complete search history.

(56) References Cited

U.S. PATENT DOCUMENTS

| | | | | |
|---|---|---|---|---|
| 4,029,386 | A | 6/1977 | Krantz | |
| 4,907,985 | A * | 3/1990 | Johnsen | 439/369 |
| 5,490,790 | A | 2/1996 | Okada | |
| 5,649,835 | A * | 7/1997 | Weed | 439/320 |
| 5,823,811 | A | 10/1998 | Blanchfield | |
| 5,964,621 | A | 10/1999 | Wolla | |
| D434,725 | S | 12/2000 | Flaugher | |
| 6,595,791 | B2 * | 7/2003 | Below et al. | 439/271 |
| 7,140,897 | B2 | 11/2006 | Axenbock | |
| 7,175,463 | B2 * | 2/2007 | Burton | 439/346 |
| 2008/0227321 | A1 | 9/2008 | Reusche | |

* cited by examiner

*Primary Examiner* — Tulsidas C Patel
*Assistant Examiner* — Travis Chambers
(74) *Attorney, Agent, or Firm* — Joseph M. Butscher; The Small Patent Law Group, LLC

(57) ABSTRACT

An extension cordset assembly includes a receptacle and a sealing gasket. The receptacle includes a receptacle main body, a receptacle connecting interface and first and second spade mating holes extending into the receptacle main body from the receptacle connecting interface. The receptacle is configured to mate with a plug having a standard spade configuration. The sealing gasket is positioned on the receptacle connecting interface and includes first and second spade openings aligned with the first and second spade mating holes, respectively. The sealing gasket is configured to provide a water-resistant seal between the receptacle and the plug.

27 Claims, 4 Drawing Sheets

CORDSET ASSEMBLY

RELATED APPLICATIONS

The present application is a continuation-in-part of U.S. application Ser. No. 12/028,257, entitled "Cordset Assembly," filed Feb. 8, 2008, now U.S. Pat. No. 7,833,037 which, in turn, claims priority from U.S. Provisional Application No. 60/895,324, entitled "Water-Resistant Locking Cordset," filed Mar. 16, 2007, U.S. Provisional Application No. 60/909,275, entitled "Water-Resistant Locking Cordset," filed Mar. 30, 2007 and U.S. Provisional Application No. 60/980,215, entitled "Water-Resistant Locking Cordset," filed Oct. 16, 2007, all of which are hereby incorporated by reference in their entireties.

The present application also claims priority to U.S. Provisional Application No. 61/181,975, entitled "Backstop for a Locking Cordset," filed May 28, 2009, which is also incorporated by reference in its entirety.

FIELD OF THE INVENTION

Embodiments of the present invention generally relate to an extension cordset assembly having a male plug and a female receptacle, and more particularly, to a water-resistant locking extension cordset assembly.

BACKGROUND OF THE INVENTION

Extension cordsets are used in homes and businesses in order to connect appliances and electronic equipment to a source of power. Typically, cordsets are designed for indoor use and configured to carry 10 amperes or less of current. Other common heavy-duty cordsets are designed to provide power to tools or machinery. While the heavy-duty cordsets may be rated for outdoor use, the rating typically applies to the water resistance of the plastic jacketing on the cord and molded pieces without addressing the ability of the cordset connections to resist moisture.

A large proportion of outdoor cordsets are used in agricultural or construction settings where they provide power for operating a hand-held power tool such as a drill or circular saw. The extension cordsets in these settings allow a user to operate a tool at a remote distance from a power outlet. Thus, the user may move about a work site with the tool.

All extension cords intended for consumer use include one of two types of male plug: a two wire, non-grounded plug, or a three-wire, grounded plug. A three-wire plug and cord is generally configured and intended for devices utilizing a three-wire power cord, in which the third wire is used to ground certain parts of the device for safety reasons.

A danger exists, however, when a three-wire power cord from a device is plugged into a two-wire extension cord. In this situation, the third prong, which is the ground wire, is not connected. Therefore, most, if not all, consumer-type, two-wire extension cords are generally required to have an obstruction located on the face of a female receptacle that prevents a three-prong plug from being inserted therein. The obstruction is positioned such that the ground pin on the plug abuts the obstruction if an attempt to insert the three-wire plug into the two-wire receptacle is made.

Additionally, a three-prong receptacle typically includes an obstruction that prevents improper insertion of a three-prong plug upside-down into a reciprocal receptacle. If no obstruction was in place, the plug could be inserted into the receptacle upside-down, such that the ground pin was exposed. While the obstruction prevents the plug from being improperly inserted, it typically serves to alert a user that the plug needs to be rotated 180 degrees in order for proper insertion.

FIG. 1 illustrates a front view of a standard three-prong receptacle 2 with an obstruction 4. The obstruction 4 is required by Underwriters Laboratories (UL) in order to prevent improper insertion of a three-prong plug. The obstruction 4 includes a semi-circular face 6 that extends above the blade inserts, and generally aligned over the ground pin insert 8.

Setting aside the issue of improper insertion of a male plug into female receptacle, a male plug of a power tool, may also be susceptible to disconnecting from a female receptacle of an outdoor cordset. In order to prevent the male plug from disconnecting from the female receptacle, some users tie an end of the power tool cord and an end of the extension cordset in a knot. However, the act of physically tying the cords together may be annoying to some users. Additionally, the knotted connection may not always be secure. Further, tying the cords together inherently decreases the length of the extension.

Also, the interface between the extension cordset and the power tool cord may be exposed to water, for example, in a puddle, where the cord may short to ground. Alternatively, the male plug and the female receptacle may partially disengage from one another, thereby exposing live electrical contacts. As such, typical extension cordsets may present a danger to users and others as well as presenting a fire hazard. This same hazard can be found in cordsets for supplying power to recreational vehicles and electric motors, for example.

Specialty cordsets exist to ensure a secure, water resistant connection between the male plug and the female receptacle. However, these specialty cordsets typically include a unique, specifically designed male and female attachment to mate the two cords together. For instance, the common two- or three-prong plug that would be found on a 120 volt device for plugging into a standard wall outlet typically cannot be used in conjunction with the specialty cordsets, thereby limiting their practicality.

SUMMARY OF THE INVENTION

Certain embodiments of the present invention provide an extension cordset assembly that includes a receptacle and a connecting nut rotatably secured to the receptacle. The receptacle and the connecting nut cooperate to prevent improper mating of a male plug with the receptacle.

The extension cordset assembly may be devoid of a separate and distinct obstruction, such as shown in FIG. 1, that would be configured to prevent improper mating with the male plug.

The receptacle may include a non-circular main body and a backstop. The receptacle may be configured to mate with a plug having a standard spade configuration.

The backstop prevents the connecting nut from receding past a front face of the receptacle to a point in which the male plug could be improperly mated with the receptacle.

The front face of the receptacle may substantially extend along the length of an inner diameter of the connecting nut along an axis that bisects the two spade mating holes.

The receptacle may include at least one drainage channel.

The receptacle may include a substantially triangular axial cross-section. Optionally, the receptacle may include a substantially pie-shaped axial cross-section.

Certain embodiments of the present invention provide an extension cordset assembly that includes a receptacle and a connecting nut. The receptacle includes a main body and a backstop. The receptacle is configured to mate with a plug having a standard spade configuration. The connecting nut is rotatably secured to the main body. The backstop prevents the connecting nut from receding past a front face of the receptacle to a point in which a three-prong male plug could be improperly mated with the receptacle. The receptacle and the connecting nut cooperate to prevent improper mating of the three-prong male plug with the receptacle.

A locking nut may be positioned between the connecting nut and the backstop. The backstop prevents the locking nut from receding past the backstop, which, in turn, prevents the connecting nut from receding past the front face of the receptacle.

Certain embodiments of the present invention provide an extension cordset assembly configured to provide electrical power from a standard outlet to an electrical device. The extension cordset assembly includes a plug, a receptacle and a sealing gasket. Optionally, the extension cordset assembly does not include the sealing gasket.

The plug includes a main body that may be triangular to facilitate use with standard electrical outlet and receptacle configurations. The plug also includes a connecting interface and a first spade, a second spade and a ground pin extending from the plug connecting interface.

The receptacle includes a main body that may be triangular in order to facilitate use with standard configurations. The receptacle also includes a receptacle connecting interface and first and second spade mating holes and a ground pin mating hole extending into the receptacle main body from the receptacle connecting interface.

The sealing gasket may also be triangular and is configured to be compressively sandwiched between another plug connecting interface and the receptacle connecting interface. The sealing gasket includes first and second spade openings aligned with the first and second spade mating holes, respectively, and a ground pin opening aligned with the ground pin mating hole. A sealing ridge may extend about a periphery of the sealing gasket. The sealing gasket may also include first and second sealing rims surrounding the first and second space openings, respectively, and a third sealing rim surrounding the ground pin opening.

The extension cordset assembly may also include a first connecting nut rotatably secured to the receptacle main body. The connecting nut is configured to threadably secure to a portion of another plug in order to secure the receptacle to the other plug.

The extension cordset assembly may also include a second connecting nut configured to threadably secure to the receptacle main body. The second connecting nut ensures that the first connecting nut remains on the receptacle main body.

The receptacle main body may also include a backstop that ensures that the second connecting nut remains on the receptacle main body.

The plug may also include an upstanding rim surrounding the plug connecting interface. The upstanding rim may cooperate with the gasket to form a sealing interface between the plug and the receptacle.

The receptacle connecting interface may include first and second spade rims surrounding the first and second spade mating holes, respectively, and a ground pin rim surrounding the ground pin opening. The first and second spade rims are positioned within the first and second spade openings, respectively, and the ground pin rim is positioned within the ground pin opening.

Certain embodiments of the present invention provide an electrical plug that includes a main body having a connecting interface, and a pair of electrical spades extending from the connecting interface. The main body includes threads on an outer surface thereof. The threads are configured to threadably engage threads formed on a connecting nut of a receptacle in order to securely connect the electrical plug to the receptacle.

The main body may include a plurality of apexes or corners, wherein the threads are located at the apexes. A rim may surround the connecting interface.

Certain embodiments of the present invention provide an extension cordset assembly that includes a plug and a receptacle. The plug includes a plug main body, a plug connecting interface and a first spade and a second spade extending from the plug connecting interface. The receptacle connects to the plug through an insulated cord. The receptacle may include a receptacle main body, a receptacle connecting interface and first and second spade mating holes extending into the receptacle main body from the receptacle connecting interface.

A first connecting nut rotatably secured to said receptacle main body is configured to threadably secure to another plug main body in order to secure the receptacle to the other plug.

At least a portion of the plug main body is threaded in order to threadably secure to another first connecting nut. A second connecting nut may be configured to threadably secure to the receptacle main body such that the second connecting nut ensures the first connecting nut remains on the receptacle main body.

Certain embodiments of the present invention provide an extension cordset assembly that includes a plug and a receptacle. The plug includes a plug main body, a plug connecting interface and first and second spades extending from the plug connecting interface, wherein the first and second spades are in a standard configuration.

The receptacle is connected to the plug through an insulated cord and includes a receptacle main body, a receptacle connecting interface and first and second spade mating holes extending into the receptacle main body from the receptacle connecting interface.

One or both of the plug connecting interface and the receptacle connecting interface are configured to provide a water-resistant seal with respect to another receptacle or another plug, respectively. For example, the connecting interfaces may be formed of elastomeric or foam material integrally formed with the main bodies.

Figure 1:
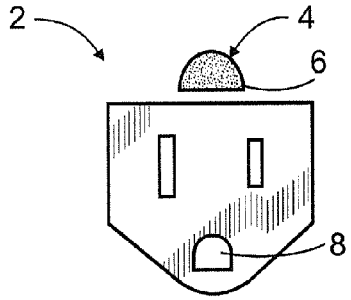
FIG. 1 illustrates a front view of a standard three-prong receptacle with an obstruction that prevents improper mating with a plug.

The foregoing summary, as well as the following detailed description of certain embodiments of the present invention, will be better understood when read in conjunction with the appended drawings. For the purpose of illustrating the invention, there are shown in the drawings, certain embodiments. It should be understood, however, that the present invention is not limited to the arrangements and instrumentalities shown in the attached drawings.

DETAILED DESCRIPTION OF THE INVENTION

Figure 2:
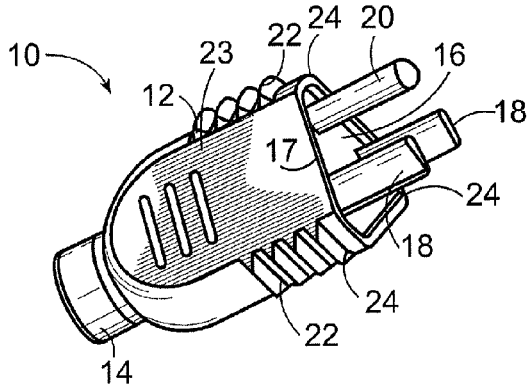
FIG. 2 illustrates an isometric view of a male plug according to an embodiment of the present invention.

FIG. 2 illustrates an isometric view of a male plug 10 according to an embodiment of the present invention. The male plug 10 includes a generally triangular main body 12, which may be formed of plastic, connected to a collar 14, which in turn connects to an insulated electrical cord (not shown). The main body 12 may be triangular to facilitate standard electrical outlets and connections. The main body 12 may be molded from, and/or coated with, insulated plastic. Optionally, the main body 12 may be integrally formed with and connected to an insulated electrical cord. In short, the collar 14 shown in FIG. 1 may be an end of an insulated electrical cord.

A connecting interface 16 is distally located from the collar 14 at an opposite end of the collar 14. An upstanding rim 17 circumscribes the connecting interface 16. A female receptacle is configured to mate into the connecting interface 16, as discussed below.

Two conducting spades or blades 18 and a ground pin 20 extend outwardly from the connecting interface 16. The spades 18 and the ground pin 20 are configured to mate with reciprocal openings formed in a female receptacle, as shown and discussed with respect to FIG. 2. The spades 18 and the ground pin 20 are configured to plug into any standard electrical outlet. The configuration of the male plug 10 may be adapted to a standard spade and ground pin configuration. As shown in FIG. 1, the spades 18 and the ground pin 20 meet the dimension requirements as set forth in FIG. 5-15 of the NEMA Standards Publication ANSI/NEMA WD 6-2002 for a 125 volt, 15 amp, 2 pole, 3 wire, grounding type plug. Alternatively, the male plug 10 may be adapted to various other electrical configurations, such as a 120 volt or 240 volt configuration and/or a 20 amp configuration. Optionally, the male plug 10 may not include the ground pin 20.

The male plug 10 may be a two or three wire assembly suitable for outdoor use. Typical designations for the male plug 10 include SJTW and SJTOW, among others.

Threads 22 are formed on an outer surface of the main body 12 between a middle portion 23 and the connecting interface 16. As shown in FIG. 1, the threads 22 do not extend over an entire outer perimeter of the main body 12. Instead, the threads 22 are formed at apexes or corners 24 of the main body 12. Optionally, the threads 22 may extend over the entire outer perimeter of the main body 12. Moreover, the threads 22 may be formed from the collar 14 to the connecting interface 16.

Figure 3:
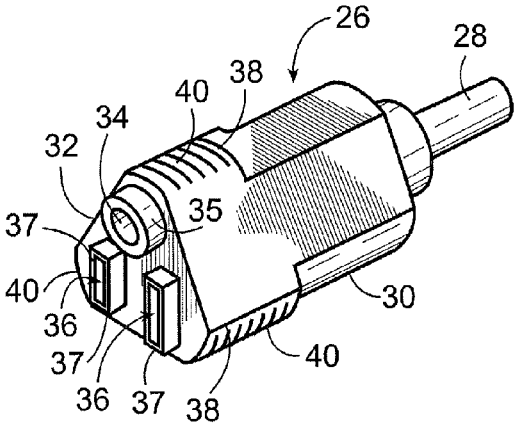
FIG. 3 illustrates an isometric view of a female receptacle according to an embodiment of the present invention.

FIG. 3 illustrates an isometric view of a female receptacle 26 according to an embodiment of the present invention. The female receptacle 26 may be connected to the male plug 10 (shown in FIG. 1) through an insulated cord 28, thereby forming an extension cordset. Thus, a male plug 10 of one extension cordset may be mated with a female receptacle 26 of another extension cordset. Moreover, the female receptacle 26 may be mated with a male plug of an electrical device, such as a power tool.

The female receptacle 26 includes a generally triangular main body 30 connected to the insulated electrical cord 28. The main body 30 may be formed of, and/or coated with, insulated plastic and includes a connecting interface 32 at an end opposite of the cord 28.

A ground pin mating hole 34 is formed through the connecting interface 32 and is configured to receive the ground pin 20 of the male plug 10 (shown in FIG. 1). A circular rim or tube 35 outwardly extends from the connecting interface 32 and surrounds the ground pin mating hole 34. Similarly, two spade mating holes 36 are formed through the connecting interface 32 and are configured to receive the spades 18 (shown in FIG. 1). Rectangular rims or walls 37 extend outwardly from the connecting interface 32 and surround the spade mating holes 36. The mating holes 34 and 36 may be configured the same as those found on a common electrical outlet and are configured to accept the electrical spades 18 and the ground pin 20 of the male plug 10 (shown in FIG. 1), as well as two-prong plugs that are polarized or un-polarized.

Shelves 38 are formed at apexes 40 of the main body 30. Optionally, the shelves 38 may extend around an entirety of the main body 30. The shelves 38 are configured to ensure that a connecting nut rotatably secures to the female receptacle 26, as discussed below.

Figure 4:
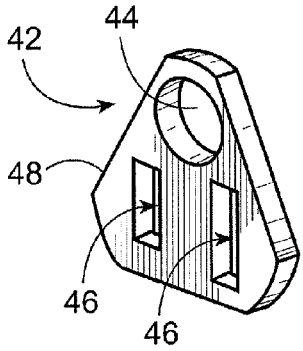
FIG. 4 illustrates an isometric view of a sealing gasket according to an embodiment of the present invention.

FIG. 4 illustrates an isometric view of a sealing gasket 42 according to an embodiment of the present invention. The sealing gasket 42 may be formed of a material that is softer than the main body 30 of the female receptacle 26. For instance, the gasket 42 may be formed of an elastomeric or foam material that is compressible and moisture resistant.

A circular grounding rim opening 44 is formed through the gasket 42. Additionally, rectangular spade rim openings 46 are formed through the gasket 42. The grounding rim opening 44 and the spade rim openings 46 are configured to receive the circular rim 35 and the rectangular rims 37, respectively (shown in FIG. 2). When the gasket 42 is positioned over the connecting interface 32, the exposed ends of the rims 35 and 37 are flush with the exposed surface 48 of the gasket 42. Further, when the male plug 10 (shown in FIG. 1) is mated with the female receptacle 26, the gasket 42 is bounded by the rim 17 (shown in FIG. 1) of the male plug 10 and is compressively sandwiched between the connecting interface 16 (shown in FIG. 1) of the male plug 10 and the connecting interface 32 of the female receptacle 26. As such, the gasket 42 provides a water-resistant seal between the connecting interfaces 16 and 32.

The gasket may be various other shapes and sizes than those shown in FIG. 4. For example, the gasket may be shaped as a ring or outer loop of material with a central opening. As such, the outer loop is configured to contact a connection interface, such as an upturned plug lip. The gasket may also be an O-ring configured to be retained within a groove formed in the plug and/or the receptacle.

While the gasket 42 is described above as attaching to the connecting interface 32 of the female receptacle 26, the plug 10 may be alternatively configured to include rims around portions of the spades 18 and ground pin 20. In this way, the gasket 42 may be attached to the plug 10. In this arrangement, the female receptacle 26 may not include the rims 35 and 37, but may include an upstanding rim surrounding the connecting interface 32.

Figure 5:
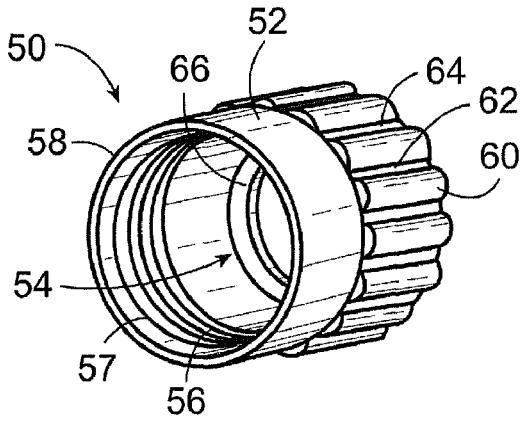
FIG. 5 illustrates an isometric view of a connecting nut according to an embodiment of the present invention.

FIG. 5 illustrates an isometric view of a connecting nut 50 according to an embodiment of the present invention. The nut 50 includes a generally cylindrical wall 52 defining an interior passage 54. An interior surface 56 of the wall 52 is threaded 57 at one end 58. Ribs 60 outwardly extend from an outer surface 62 of the wall 52 proximate another end 64. The ribs 60 provide structures for a user to easily grasp so that the user may rotate the nut 50 when it is connected to the female receptacle 26 (shown in FIG. 2).

Referring to FIGS. 3 and 5, the nut 50 is positioned on the female receptacle 26 so that the main body 30 is positioned within the interior passage 54. That is, the nut 50 surrounds the main body 30 while exposing the connecting interface 32. The shelves 38 formed at the apexes 40 of the main body 30 abut into the interior surface 56 of the cylindrical wall 52 of the nut 50, thereby preventing the nut 50 from separating from the female receptacle 26. For example, a ledge 66 may extend from the interior surface 56 and into the interior passage 54. If the nut 50 axially shifts with respect to the female receptacle 26, the ledge 66 is blocked from further movement by the shelves 38. While the shelves 38 prevent the nut 50 from slipping off the female receptacle 26, the nut 50 is otherwise free to rotate about the main body 30 of the female receptacle 26.

Figure 6:
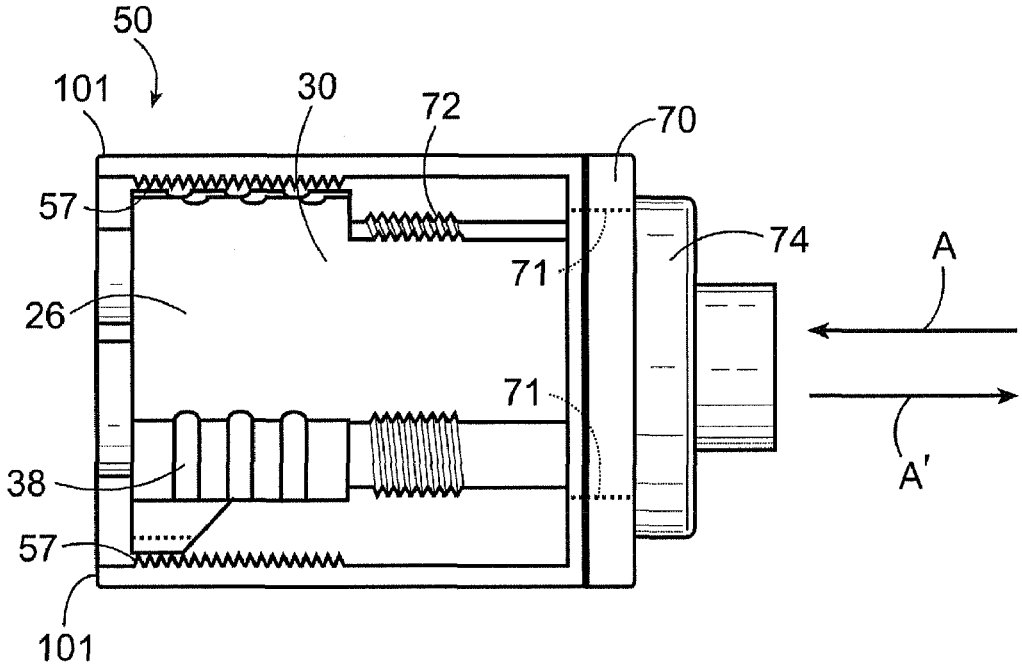
FIG. 6 illustrates a simplified, partial cross-sectional view of a connecting nut secured to a female receptacle according to an embodiment of the present invention.

FIG. 6 illustrates a simplified, partial cross-sectional view of the connecting nut 50 secured to the female receptacle 26 according to an embodiment of the present invention. A second, thinner nut 70 may be tightened against the connecting nut 50 to prevent the nut 50 from loosening during operation.

The locking nut 70 includes a smaller opening or interior passage 71 than that of the nut 50. As shown in FIG. 6, the nut 70 is configured to threadably engage threads 72 formed around a recessed portion of the main body 30. As the nut 70 is urged in the direction of arrow A, the nut 50 also moves in the same direction, thereby moving the threads 57 away from the main body 30 in the direction of arrow A. The nut 70 then threadably engages the threads 72 in order to secure the nut 70 to the female receptacle 26, thereby preventing the nut 50 from retreating in the direction of arrow A'.

The female receptacle 26 may also include a backstop 74 behind the nut 70 that prevents the nut 70 from slipping off the female receptacle 26. As shown in FIG. 6, the diameter of the backstop 74 is greater than the opening 71 formed through the nut 70. As such, the backstop 74 provides a stop that prevents the nut 70 from slipping past in the direction of arrow A'.

Once the nut 70 threadably engages and securely tightens to the female receptacle 26, the nut 50 is free to rotate about the female receptacle 26, but is prevented from retreating in the direction of arrow A'. In this position, the nut 50 may threadably secure to the male plug 10 shown in FIG. 1.

Referring to FIGS. 2-6, the nut 50 secures to the male plug 10 by the threads 57 engaging the threads 22 of the male plug 10. Once securely tightened, the nut 50 ensures that the male plug 10 is securely connected to the female receptacle 26. That is, the nut 50 is tightened around the male plug 10 to prevent the male plug 10 from disconnecting from the female receptacle 26. Further, as the nut 50 threadably engages the male plug 10, the gasket 42 is compressively sandwiched between the connecting interfaces 16 and 32 of the male plug 10 and the female receptacle 26, respectively, thereby providing a secure, water-resistant connection between the male plug 10 and the female receptacle 26.

Figure 7:
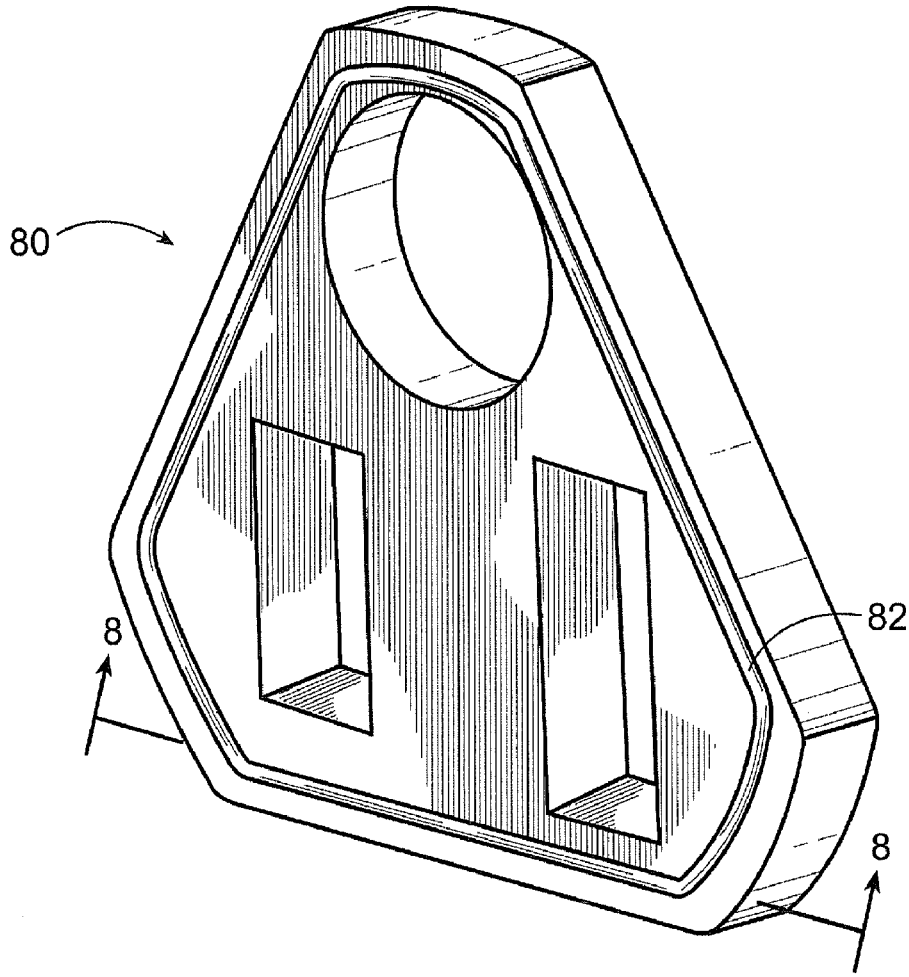
FIG. 7 illustrates an isometric front view of a gasket according to an embodiment of the present invention.
Figure 8:
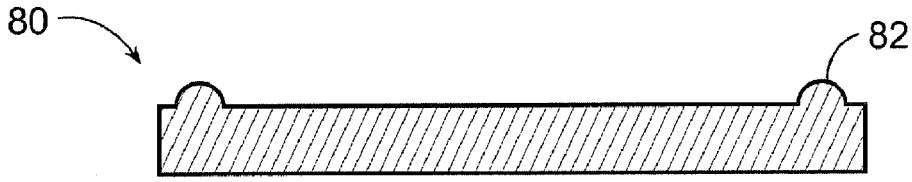
FIG. 8 illustrates a cross-sectional view of a gasket through line 8-8 of FIG. 7 according to an embodiment of the present invention.

FIG. 7 illustrates an isometric front view of a gasket 80 according to an embodiment of the present invention. FIG. 8 illustrates a cross-sectional view of the gasket 80 through line 8-8 of FIG. 7. As shown in FIGS. 7 and 8, a raised ridge 82 is formed around a periphery of the gasket 80. The gasket 80 may be used with the male plug 10 and the female receptacle 26 shown and described in FIGS. 2 and 3. In this case, the male plug 10 may not include the raised rim 17 (shown in FIG. 2) circumscribing the connecting interface 16 (shown in FIG. 2). Instead, the raised ridge 82 compresses between the connecting interfaces 16 and 32 and may provide a suitable seal between the male plug 10 and the female receptacle 26. However, the raised rim 17 may be used to provide additional sealing.

Figure 9:
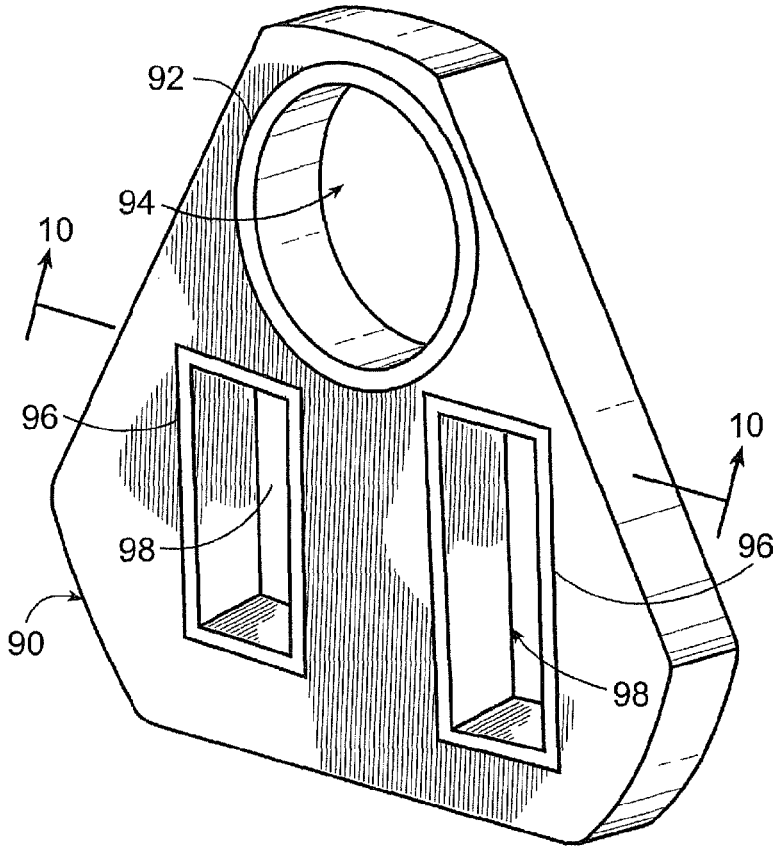
FIG. 9 illustrates an isometric front view of a gasket according to an embodiment of the present invention.
Figure 10:
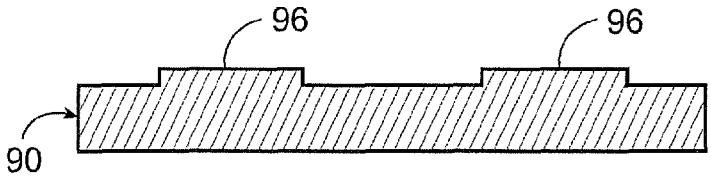
FIG. 10 illustrates a cross-sectional view of a gasket through line 10-10 of FIG. 9 according to an embodiment of the present invention.

FIG. 9 illustrates an isometric front view of a gasket 90 according to an embodiment of the present invention. FIG. 10 illustrates a cross-sectional view of the gasket 90 through line 10-10 of FIG. 9. As shown in FIGS. 9 and 10, the gasket 90 includes a raised rim 92 around a ground pin opening 94 and raised rims 96 about spade openings 98. The gasket 90 may be used with flat faced plugs and receptacles. The raised rims 92 and 96 form seals between connecting interfaces around each individual pin and spade, respectively. The area of the gasket 90 immediately surrounding each pin and spade may be thicker than the edge of the gasket 90 so as to form a positive seal around each pin and spade.

As noted above, a male plug is connected to a female receptacle through an insulated cord to form an extension cordset. The male plug of one extension cordset may be mated with a female receptacle of another extension cordset. The male plug can also be plugged into a standard outlet to provide power to a particular device. Likewise, a device without a threaded plug may be inserted into a female receptacle of the extension cordset just like a standard extension cordset. Additionally, individual cordsets may be locked together to form longer extensions.

As discussed above, various embodiments of the present invention include a sealing gasket. Alternatively, the plug and receptacle may be formed such that their connecting interfaces are formed of a material that is softer than their respective main bodies. For example, the connecting interfaces may be formed of an elastomeric or foam material that is compressible and moisture resistant. Thus, a separate and distinct gasket may not be needed with respect to these alternative embodiments. However, the gaskets described above allow standard plugs and receptacles to be retrofit to provide moisture resistance.

Thus, embodiments of the present invention provide an extension cordset that provides secure, water-resistant connections between male plugs and female receptacles. Additionally, embodiments of the present invention may be used with standard plugs, outlets and receptacle configurations.

Figure 11:
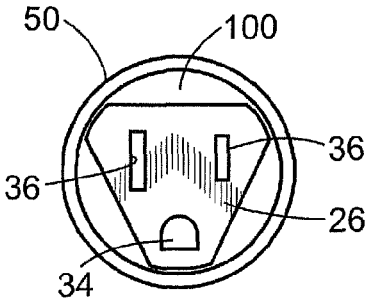
FIG. 11 illustrates a simplified front view of a connecting nut secured to a female receptacle according to an embodiment of the present invention.

FIG. 11 illustrates a simplified front view of the connecting nut 50 secured to the female receptacle 26. As shown in FIG. 11, neither the nut 50, nor the receptacle 26 includes a semicircular obstruction, such as that shown in FIG. 1.

If an obstruction, such as shown in FIG. 1, extended from the face of a plug, for example, the face of the receptacle 26 would need to be enlarged. In order to accommodate this expanded area, the plug diameter would also need to be increased. It has been found that inclusion of an obstruction on the plug would yield a plug that is 50% wider in order to securely engage the nut 50. However, the additional material would increase manufacturing costs. Therefore, embodiments of the present invention provide a plug, receptacle, and nut that prevent improper insertion of the plug into the receptacle, while minimizing the size of the plug, as described below.

As shown in FIG. 11, however, a space 100 between the receptacle 26 and the connecting nut 50 exists. The space 100 is proximate the spade mating holes 36. Thus, there is a potential for a ground pin of a plug to be inserted into the space 100. However, because of the connecting nut 50, if the ground pin is positioned into the space 100, the spades of the plug would not be able to be inserted into the spade mating holes 36. That is, the connecting nut 50 would prevent the ground pin from being in a position that would allow the spades to be inserted into the spade mating holes 36. As such, the connecting nut 50 cooperates with the receptacle 26 to act as an obstruction that prevents the spades of the plug from being improperly inserted into the spade mating holes 36.

Referring to FIG. 6, the connecting nut 50 is shown in its fully retracted position. In this position, the backstop 74 prevents the nut 70 from retreating further in the direction of arrow A'. The backstop 74 is molded to, integrally formed with, or otherwise secured to, the rear of the receptacle 26 at a distance that prevents the connecting nut 50 from receding past the front face of the receptacle 26. Consequently, the nut 70 prevents the connecting nut 50 from further movement in the direction of arrow A'. As such, distal edges 101 of the connecting nut are unable to longitudinally recede past the front face of the receptacle 26 in the direction of arrow A'. Therefore, the front face of the receptacle 26 is unable to extend past the edges 101 of the connecting nut 50 in the direction of arrow A. The connecting nut 50 will always be at least flush with the front face of the receptacle 26, thereby ensuring that the connecting nut 50 and receptacle 26 cooperate to provide a built-in obstruction, as discussed above, even when in a fully retracted position.

Alternatively, the backstop 74 may be positioned to allow the connecting nut 50 to recede slightly past the front face of the receptacle 26 in the direction of arrow A. However, the spatial differential between the outer edges 101 of the connecting nut 50 and the front face of the receptacle 26 is still sufficient to prevent the spades of the male plug from being inserted into the spade mating holes 36, due to the ground pin being slightly longer than the spades. Thus, the backstop 74 is spaced such that the distance that the front edges 101 of the connecting nut 50 may recede past the front face of the receptacle 26 is less than the length differential between the ground pin and the spades.

Figure 12:
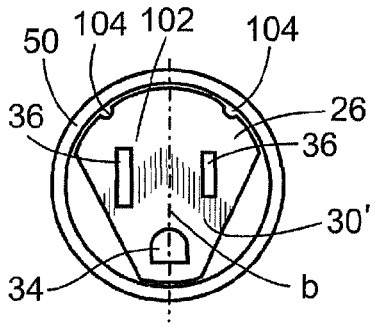
FIG. 12 illustrates a simplified front view of a connecting nut secured to a female receptacle according to an embodiment of the present invention.

FIG. 12 illustrates a simplified front view of the connecting nut 50 secured to a female receptacle 26' according to an embodiment of the present invention. The receptacle 26' includes an expanded main body 30', such that a front face 102 extends upwardly (in the orientation shown in FIG. 12) from locations proximate the spade mating holes 36 into the connecting nut 50, thereby resembling a pie-like shape (as opposed to the triangular shape shown in FIG. 11). Drainage channels 104 are formed at upper portions of the main body 30'. The drainage channels 104 prevent moisture from collecting adjacent the receptacle face when a plug is coupled to the receptacle 26'. The drainage channels 104 extend along the longitudinal surface of the main body 30' and allow water to drain away from the face of the receptacle 26'. While two drainage channels 104 are shown, more or less drainage channels 104 around the perimeter of the main body 30' may be used.

The front face 102 of the receptacle 26 substantially extends over an inner diameter of the connecting nut 50 along an axis b that bisects the two spade mating holes 36. That is, while the front face 102 extends over most of the inner diameter of the connecting nut 50 along the axis b, it does not necessarily abut into inner walls of the connecting nut 50.

While the expanded front face 102 is shown as substantially extending over the inner diameter of the connecting nut 50, the front face 102 may optionally be expanded to a point in which a ground pin would be incapable of fitting into a resulting gap between the connecting nut 50 and the front face 102. That is, the diameter of the ground pin is greater than any resulting gap. Nevertheless, the front face 102 still substantially extends over the inner diameter along the axis b.

Thus, embodiments of the present invention provide a cordset assembly that prevents a male plug from being improperly connected/mated (that is, in which the spades are inserted into spade mating holes, but the ground pin is not inserted to a ground pin mating hole) into a female receptacle.

While various spatial terms, such as upper, bottom, lower, mid, lateral, horizontal, vertical, and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. An extension cordset assembly comprising:

a receptacle comprising a non-circular main body and a backstop, said receptacle configured to mate with a plug having a standard spade configuration; and a connecting nut rotatably secured to said non-circular main body, wherein said backstop prevents said connecting nut from receding past a non-circular front face of said receptacle to a point in which a three-prong male plug could be improperly mated with said receptacle, wherein said receptacle and said connecting nut cooperate to prevent improper mating of the three-prong male plug with said receptacle.

2. The extension cordset assembly of claim 1, wherein said backstop prevents at least a portion of said connecting nut from receding past said front face of said receptacle.

3. The extension cordset assembly of claim 1, wherein said backstop is integrally formed with said receptacle.

4. The extension cordset assembly of claim 1, wherein said non-circular main body comprises at least one drainage channel formed over a length of said non-circular main body, and wherein said at least one drainage channel is underneath said connecting nut.

5. The extension cordset assembly of claim 1, wherein said front face is substantially triangular.

6. The extension cordset assembly of claim 1, wherein said front face is substantially pie-shaped.

7. The extension cordset assembly of claim 1, wherein said connecting nut is configured to threadably secure to a portion of the plug in order to secure said receptacle to the plug.

8. The extension cordset assembly of claim 1, wherein said backstop prevents at least a portion of said connecting nut from ever receding past said front face of said receptacle.

9. The extension cordset assembly of claim 1, further comprising a locking nut positioned between said connecting nut and said backstop, wherein said backstop prevents said locking nut from receding past said backstop, which, in turn, prevents said connecting nut from receding past said front face of said receptacle.

10. The extension cordset assembly of claim 3, wherein said backstop ensures that said locking nut remains on said main body.

11. The extension cordset assembly of claim 1, wherein said receptacle comprises two spade mating holes and one ground pin mating hole.

12. The extension cordset assembly of claim 11, wherein said front face of said receptacle substantially extends along an inner diameter of said connecting nut along an axis that bisects said two spade mating holes.

13. An extension cordset assembly comprising:

a receptacle comprising a non-circular main body, two spade mating holes, one ground pin mating hole, and a backstop;

a connecting nut rotatably secured to said receptacle main body, wherein said backstop prevents said connecting nut from receding past a non-circular front face of said receptacle to a point in which a three-prong male plug could be improperly mated with said receptacle, wherein said connecting nut is configured to threadably secure to a portion of the three-prong male plug in order to secure said receptacle to the plug; and a locking nut positioned between said connecting nut and said backstop, wherein said backstop prevents said locking nut from receding past said backstop, which, in turn, prevents said connecting nut from receding past said non-circular front face of said receptacle, wherein said backstop ensures that said locking nut remains on said non-circular main body, wherein said receptacle and said connecting nut cooperate to prevent improper mating of the three-prong male plug with said receptacle.

14. The extension cordset assembly of claim 13, wherein said front face of said receptacle substantially extends along an inner diameter of said connecting nut along an axis that bisects said two spade mating holes.

15. The extension cordset assembly of claim 13, wherein said backstop is integrally formed with said receptacle.

16. The extension cordset assembly of claim 13, wherein said main body comprises at least one drainage channel formed over a length of said non-circular main body, and wherein said at least one drainage channel is underneath said connecting nut.

17. The extension cordset assembly of claim 13, wherein said front face is substantially triangular.

18. The extension cordset assembly of claim 13, wherein said front face is substantially pie-shaped.

19. An extension cordset assembly comprising:

a non-circular receptacle; and a connecting nut rotatably secured to said receptacle, wherein said non-circular receptacle and said connecting nut cooperate to prevent improper mating of a male plug with said non-circular receptacle.

20. The extension cordset assembly of claim 19, wherein at least a portion of said connecting nut is prevented from receding past a non-circular front face of said non-circular receptacle.

21. The extension cordset assembly of claim 19, wherein said non-circular receptacle is devoid of a separate and distinct obstruction configured to prevent improper mating with the male plug.

22. The extension cordset assembly of claim 19, wherein a non-circular front face of said receptacle substantially extends along an inner diameter of said connecting nut along an axis that bisects said two spade mating holes.

23. The extension cordset assembly of claim 19, wherein said non-circular receptacle comprises at least one drainage channel, and wherein said at least one drainage channel is underneath said connecting nut.

24. The extension cordset assembly of claim 19, wherein said receptacle comprises a substantially triangular axial cross-section.

25. The extension cordset assembly of claim 19, wherein said receptacle comprises a substantially pie-shaped axial cross-section.

26. The extension cordset assembly of claim 19, wherein said non-circular receptacle comprises a non-circular main body and a backstop, said non-circular receptacle configured to mate with a plug having a standard spade configuration.

27. The extension cordset assembly of claim 26, wherein said backstop prevents said connecting nut from receding past a front face of said non-circular receptacle to a point in which the male plug could be improperly mated with said non-circular receptacle.

* * * * *